United States Patent [19]

Becker

[11] Patent Number: 5,033,379

[45] Date of Patent: Jul. 23, 1991

[54] DEVICE FOR ADJUSTING A SHEET FORMAT ON A SHEET-GUIDING DRUM OF A PRINTING MACHINE

[75] Inventor: Willi Becker, Bammental, Fed. Rep. of Germany

[73] Assignee: Heidelberger Druckmaschinen AG, Heidelberg, Fed. Rep. of Germany

[21] Appl. No.: 507,384

[22] Filed: Apr. 10, 1990

[30] Foreign Application Priority Data

Apr. 10, 1989 [DE] Fed. Rep. of Germany ..... 3911630

[51] Int. Cl.[5] ..... B41F 5/02; B41F 1/30

[52] U.S. Cl. ..... 101/230

[58] Field of Search ..... 101/230, 231, 248, 408, 101/409, 410, 411, 183; 271/82, 184, 186, 902, 225, 277

[56] References Cited

U.S. PATENT DOCUMENTS 4,122,773 10/1978 Wirz ..... 101/230
4,147,105 4/1979 Becker ..... 101/230
4,563,951 1/1986 Mathes et al. .

*Primary Examiner*—J. Reed Fisher
*Attorney, Agent, or Firm*—Herbert L. Lerner; Laurence A. Greenberg

[57] ABSTRACT

Device for adjusting a sheet format on a sheet-guiding drum of a printing machine having at least one supporting element for a sheet processing device mounted on a shaft of the drum and being adjustable in circumferential direction of the drum shaft, comprising an adjusting shaft mounted in the drum shaft and operatively connected to the sheet processing device for adjusting the sheet processing device, the adjusting shaft having a turning element at an outwardly extending end thereof, and a pinion located at an inner end thereof, the drum shaft having a bearing journal of solid material formed with a bore wherein the adjusting shaft is mounted eccentrically and substantially parallel to a central longitudinal axis of the drum shaft, and a toothed segment disposed on an end face of the supporting element at a location adjacent to the bearing journal, the pinion on the adjusting shaft being in meshing engagement with the toothed segment.

8 Claims, 4 Drawing Sheets

DEVICE FOR ADJUSTING A SHEET FORMAT ON A SHEET-GUIDING DRUM OF A PRINTING MACHINE

The invention relates to a device for adjusting a sheet format on a sheet-guiding drum of a printing machine and, more particularly, on a storage drum of a sheet-fed offset printing machine convertible selectively from single-page to first form and perfector printing and vice versa, which includes at least one supporting element for a sheet processing device such as a sheet-gripping device or a sheet-smoothing device mounted on a shaft of the drum and being adjustable in circumferential direction of the drum shaft.

Such a device is described and illustrated in German Published Non-Prosecuted Application (DE-OS) 34 10 689 using a storage drum in a sheet-fed offset printing machine as an example. In such machines with devices for turning the sheets, many elements are needed for accurate sheet guidance. In the conventional method of turning the sheet at its trailing edge in general practice, the sheet is exactly aligned, held and smoothed on a storage drum prior to turning. This is performed by smoothing mechanisms formed either of suction devices alone or grippers alone and of a combination of suction devices and grippers, respectively. The position of these smoothing mechanisms with respect to the transport grippers for transporting the sheet must be adjusted to the format of the sheets to be processed and should therefore be adjusted when changing the sheet format and when converting from first-form mode to first form and perfecting mode and, in fact, usually independently of the conversion or changeover of the transport and turning grippers. For this adjustment, the smoothing mechanisms are disposed on a supporting element which is swivel-mounted on the drum shaft and is lockable with the body of the drum in any desired rotational position by clamping, so that when the clamping action is released, an infinitely variable or stepless adjustment can be performed.

In the case of the heretofore known device, an adjustment device with an adjusting shaft turnable from the outside is provided. This adjustment device is supported centrally in a hollow shaft associated with the clamping elements, the hollow shaft being concentrically supported in a hollow (tubular) drum shaft. At an outwardly extending end of the adjusting shaft, a hexagon socket permits the adjusting shaft to be turned by means of a suitably profiled tool. The adjusting shaft has an inner end which extends, for reasons pertaining to the system, over more than half the width of the drum, well into the hollow shaft, the pinion secured there at meshing with an idler gear rotatably mounted in the wall of the hollow shaft, the idler gear being in meshing engagement with a toothed segment fastened to the supporting element. Such an adjustment device is indeed actuable from the outside, however, it is complicated to manufacture and to assemble. Hollow shafts for bearing the storage drum result in a weakening of the drum shaft journal.

It is accordingly an object of the invention to provide, from a relatively small number of easily assemblable parts, a device for adjusting a sheet format in accordance with the invention which is serviceable or actuable from the outside and which can be accommodated without any marked weakening of the bearing journal or pin.

With the foregoing and other objects in view, there is provided in accordance with the invention, a device for adjusting a sheet format on a sheet-guiding drum of a printing machine having at least one supporting element for a sheet processing device mounted on a shaft of the drum and being adjustable in circumferential direction of the drum shaft, comprising an adjusting shaft mounted in the drum shaft and operatively connected to the sheet processing device for adjusting the sheet processing device, the adjusting shaft having a turning element at an outwardly extending end thereof, and a pinion located at an inner end thereof, the drum shaft having a bearing journal of solid material formed with a bore wherein the adjusting shaft is mounted eccentrically and substantially parallel to a central longitudinal axis of the drum shaft, and a toothed segment disposed on an end face of the supporting element at a location adjacent to the bearing journal, the pinion on the adjusting shaft being in meshing engagement with the toothed segment.

In accordance with alternative features of the invention, the sheet-processing device is a device for gripping a sheet or for smoothing a sheet.

What is remarkable with regard to the device according to the invention is that a short, relatively thin adjusting shaft is disposed in a bore of correspondingly small diameter formed eccentrically in a drum-shaft bearing journal formed of solid material and, with a pinion mounted on this adjusting shaft, meshes directly with a toothed segment which is located on an end face of a supporting element located adjacent to this bearing journal. The bore provided for the bearing of the adjusting shaft, and a lateral recess formed in the bearing journal and necessary for outwardly extending the pinion on the adjusting shaft do not cause any significant weakening.

In accordance with a further feature of the invention, another pinion is mounted on the outwardly extending end of the adjusting shaft, and an indicator ring is rotatably mounted substantially concentrically to the central longitudinal axis of the drum shaft and formed with internal toothing, the other pinion having toothing in meshing engagement with the internal toothing of the indicator ring, and cooperatively associated with a fixed format scale.

In accordance with an additional feature of the invention, the indicator ring is formed with a projection on a rear side thereof, and the adjusting device includes a drive gear having an end face formed with a ring groove profiled complimentarily to the projection, the projection engaging in the ring groove.

The features of the invention are suitable both for manual operation of the adjusting device and for motorized adjustment. For manual operation, a conventional hexagon or similar device is provided at the outer end of the adjusting shaft.

In accordance with an added feature of the invention, the device includes a plurality of retaining bolts formed with respective collars at the heads thereof, the indicator ring having a rim by which the indicator ring engages behind the collars of the retaining bolts.

In the case of a motorized or motor-driven device for format adjustment, the pinion located at the outer end of the adjusting shaft meshes with a driving pinion having a casing which is held firmly on the frame of the printing machine. This driving pinion is mounted concentrically for pivoting in the bearing journal of the drum shaft and is coupled with a servomotor.

Thus, in accordance with a concomitant feature of the invention, the device includes another pinion mounted on the outwardly extending end of the adjusting shaft, and a drive pinion couplable with a drive motor serving as a servomotor is rotatably mounted substantially concentrically on the bearing journal, the other pinion being in meshing engagement with the drive pinion.

Other features which are considered as characteristic for the invention are set forth in the appended claims.

Although the invention is illustrated and described herein as embodied in a device for adjusting a sheet format on a sheet-guiding drum of a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
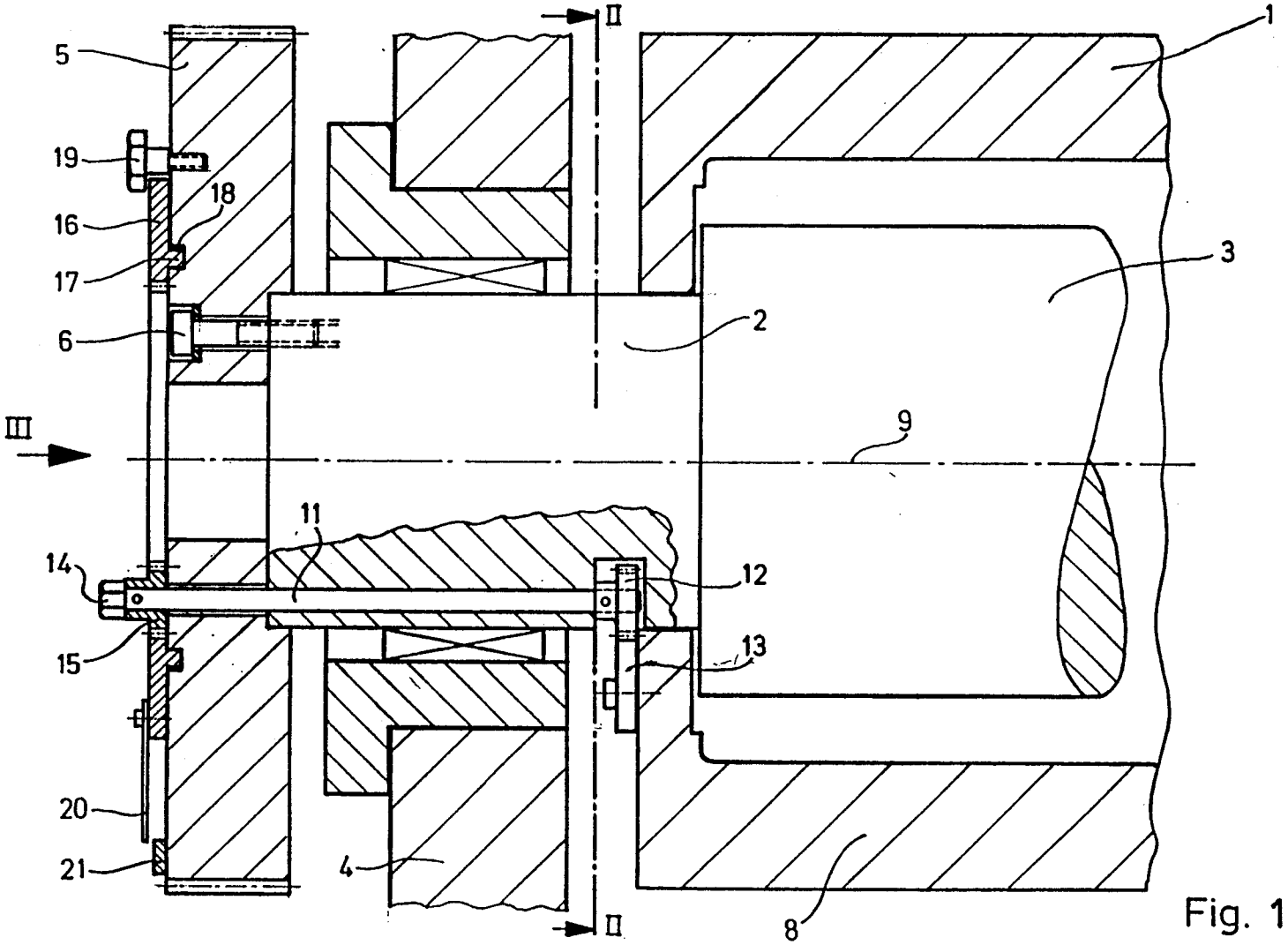
FIG. 1 is a fragmentary longitudinal sectional view in an axial plane through one bearing of a storage drum provided with the format-adjusting device according to the invention.
Figure 2:
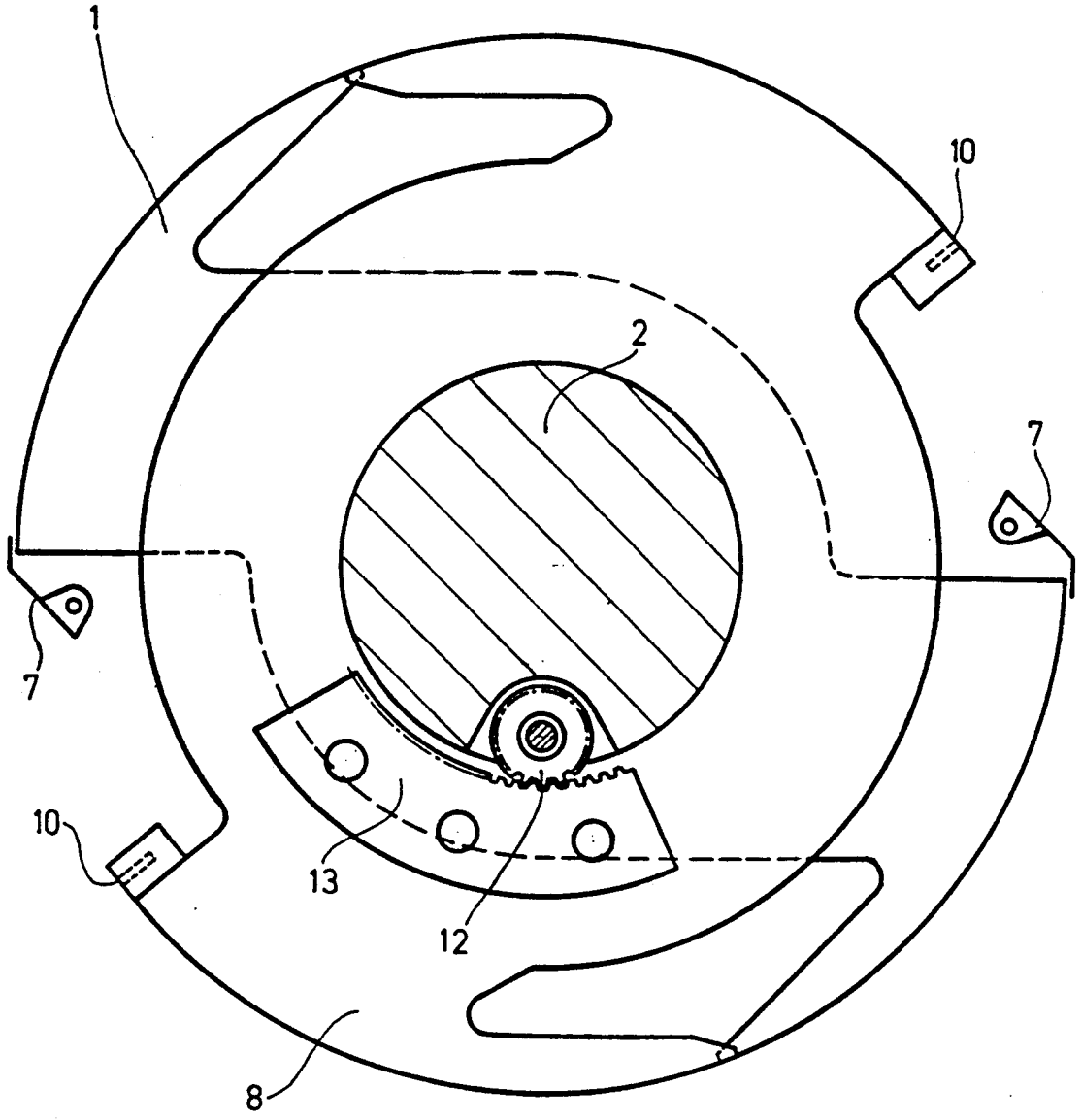
FIG. 2 is a cross-sectional view of FIG. 1 taken along the line II—II in the direction of the arrows.
Figure 3:
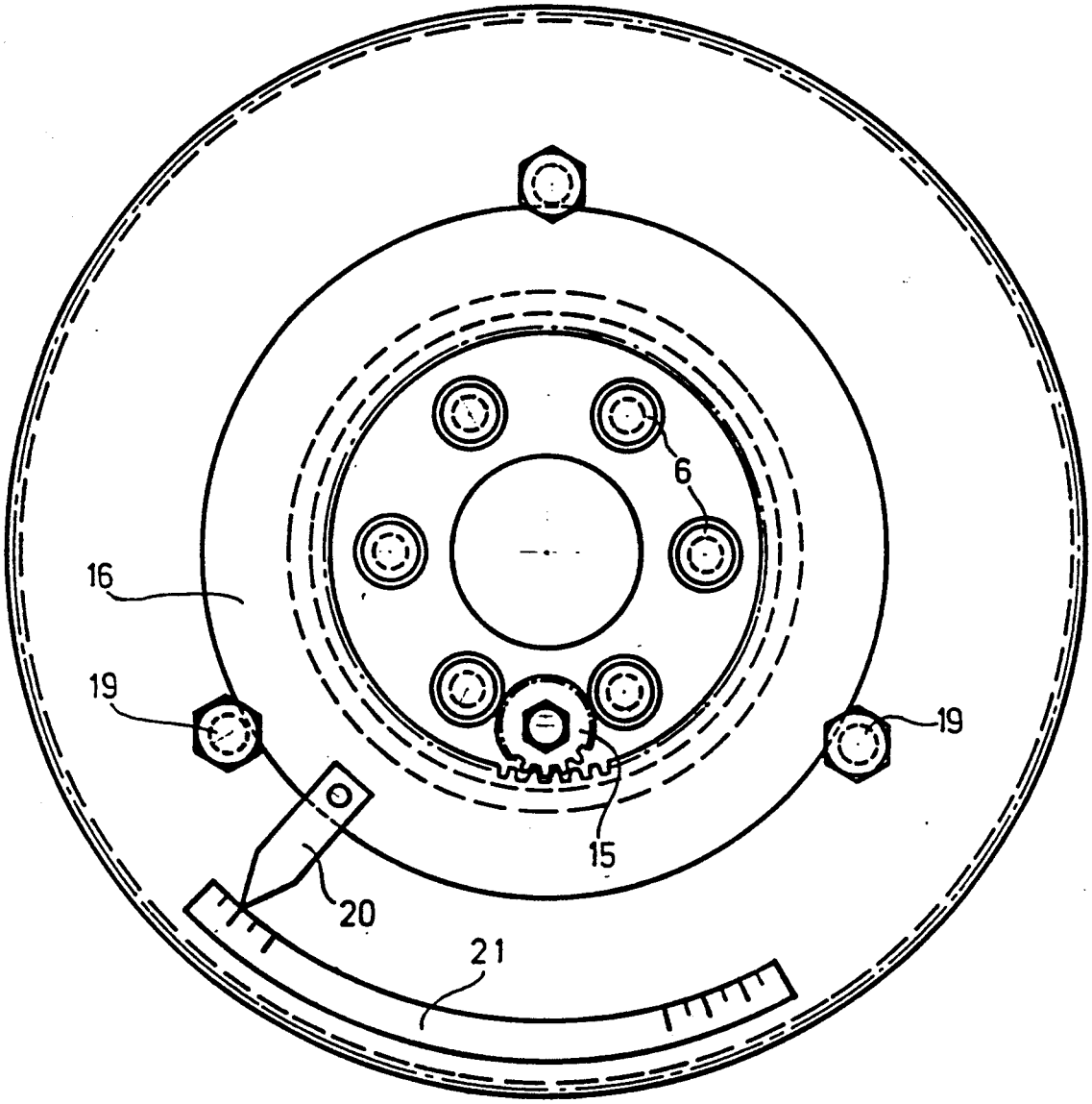
FIG. 3 is an end view of FIG. 1 as seen in the direction of the arrow III.

Referring now to the drawing and, first, particularly to FIGS. 1 to 3, there is shown therein a storage drum 1 supported at both ends in a machine frame 4 by bearing journals 2 of a shaft 3 formed of solid material and drivable by a gear 5 disposed in a chain of drive gears, the gear 5 being firmly connected by bolts 6 to an end face of the respective bearing journals 2. Diagrammatically represented sheet grippers 7 (FIG. 2) are mounted in a conventional manner in the storage drum 1. Opposite the body of the storage drum 1 is a supporting element 8 having an angle of rotation which is stepless, i.e. infinitely variable in setting about a longitudinal axis 9 of the drum shaft 3, and is firmly clampable with the body of the storage drum 1 in a set position by means of a non-illustrated clamping device. Suction nozzles 10, which serve as a sheet-smoothing mechanism, are shown by way of example in FIG. 2. They are disposed in an axial channel formed between the supporting element 8 and the body of the storage drum 1, i.e. the drum channel, and are located opposite the grippers 7.

A mechanism for adjusting the supporting element 8 with respect to the body of the storage drum 1 is formed of an adjusting shaft 11 (FIG. 1) pivotally mounted in a bore formed in the bearing journal 2 and disposed asymmetrically to the central longitudinal axis 9 and extending in a direction parallel thereto. The adjusting shaft 11 has an inner end bearing a pinion 12 which is rotatable in a lateral recess of limited depth, the pinion 12 having teeth meshing directly with inwardly disposed teeth of a toothed segment 13 which is fastened to the face of the supporting element 8 adjacent to the bearing journal 2. The toothed segment 13 extends over the maximum range of adjustment on the supporting element 8. The other end of the adjusting shaft 11 extends to the outside and passes through the gear 5. In the embodiment of the invention illustrated in FIGS. 1 to 3, the other end of the adjusting shaft 11 is formed with a hexagon head 14 which permits the adjusting shaft 11 to be turned by means of a suitably configured tool. Below the hexagon head 14, another pinion 15 is mounted on the adjusting shaft 11 and has teeth which mesh with inner toothing of an indicator ring 16 disposed concentrically to the central longitudinal axis 9 and held rotatably at the face of the bearing journal 2 and gear 5, respectively. The indicator ring 16 has, on an inner side thereof, a ring-shaped or circular projection 17 which engages in a correspondingly profiled circular or ring groove 18 formed in the end face of the gear 5. The outer rim of the indicator ring 16 grips behind head-like enlargements formed on several fastening or retaining bolts 19 which are distributed around the circumference. A pointer 20 fastened to the indicator ring 16 cooperates with a scale 21 provided on the gear 5. This scale 21 is coordinated with the sheet formats which can be processed by the printing machine. The format setting obtained by turning the adjusting shaft 11 with the aid of the hexagon head 14 is indicated on the scale 21 by the pointer 20.

Figure 4:
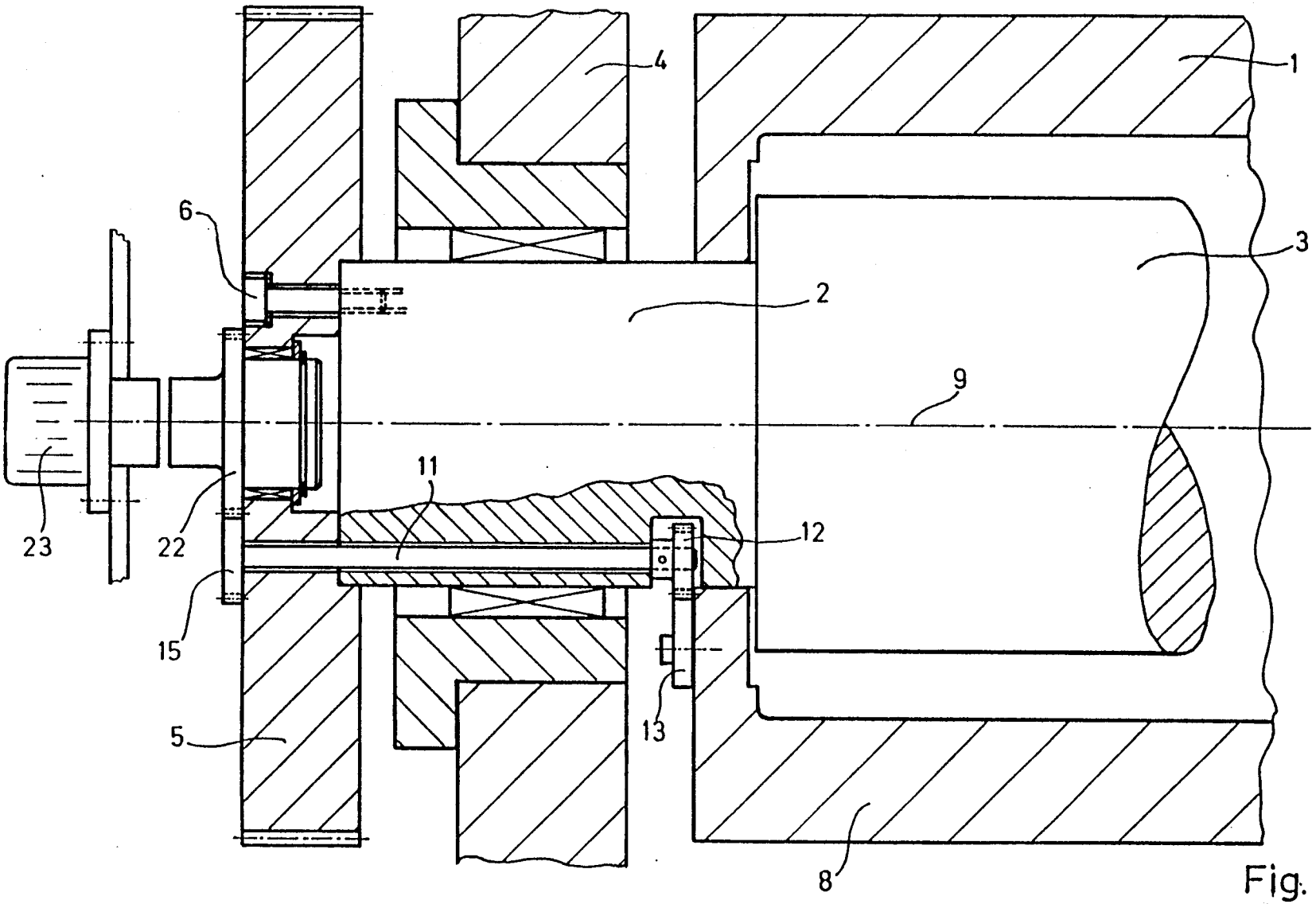
FIG. 4 is a view like that of FIG. 1 of another embodiment of the invention having a motorized adjusting drive.

In the case of a motorized format adjustment, the necessity for showing the set format is dispensed with. As shown in FIG. 4, the pinion 15 located at the outer end of the adjusting shaft 11 is used for transmitting driving forces. In the illustrated embodiment of FIG. 4, this pinion 15 meshes with a driving pinion 22 which is freely rotatably mounted in the gear 5 concentrically to the central longitudinal axis 9 and is couplable to a drive motor 23, for example an electric drive motor. In other respects the configuration of the embodiment of FIG. 4 corresponds to the embodiment of the invention according to FIGS. 1 to 3.

The foregoing is a description corresponding in substance to German Application P 39 11 630.1, dated Apr. 10, 1989, the International priority of which is being claimed for the instant application, and which is hereby made part of this application.

I claim:

1. Device for adjusting a sheet format on a sheet-guiding drum of a printing machine having at least one supporting element for a sheet processing device mounted on a shaft of the drum and being adjustable in circumferential direction of the drum shaft, comprising an adjusting shaft mounted in the drum shaft and operatively connected to the sheet processing device for adjusting the sheet processing device, said adjusting shaft having a turning element at an outwardly extending end thereof, and a pinion located at an inner end thereof, the drum shaft having a bearing journal of solid material formed with a bore wherein said adjusting shaft is mounted eccentrically and substantially parallel to a central longitudinal axis of the drum shaft, and a toothed segment disposed on an end face of the supporting element at a location adjacent to said bearing journal, the pinion on said adjusting shaft being in meshing engagement with said toothed segment.

2. Device according to claim 1, wherein the sheet processing device is a device for gripping a sheet.

3. Device according to claim 1, wherein the sheet processing device is a sheet-smoothing device.

4. Device according to claim 1, wherein the supporting element is pivotally and adjustably mounted, and said toothed segment is threadedly secured thereto.

5. Device according to claim 1, including another pinion mounted on said outwardly extending end of said adjusting shaft, and an indicator ring rotatably mounted substantially concentrically to said central longitudinal axis of the drum shaft and formed with internal toothing, said other pinion having toothing in meshing engagement with said internal toothing of said indicator ring, and cooperatively associated with a fixed format scale.

6. Device according to claim 5, wherein said indicator ring is formed with a projection on a rear side thereof, and including a drive gear having an end face formed with a ring groove profiled complementary to said projection, said projection engaging in said ring groove.

7. Device according to claim 6, including a plurality of retaining bolts formed with respective collars at the heads thereof, said indicator ring having a rim by which said indicator ring engages behind said collars of said retaining bolts.

8. Device according to claim 1, including another pinion mounted on said outwardly extending end of said adjusting shaft, and a drive pinion couplable with a drive motor serving as a servomotor is rotatably mounted substantially concentrically on said bearing journal, said other pinion being in meshing engagement with said drive pinion.

* * * * *